US012114713B2

(12) United States Patent
Elements

(10) Patent No.: US 12,114,713 B2
(45) Date of Patent: Oct. 15, 2024

(54) FASHIONABLE SHAPEWEAR

(71) Applicant: Laurianda Christina Elements, Richmond, VA (US)

(72) Inventor: Laurianda Christina Elements, Richmond, VA (US)

( * ) Notice: Subject to any disclaimer, the term of this patent is extended or adjusted under 35 U.S.C. 154(b) by 0 days.

(21) Appl. No.: 17/071,882

(22) Filed: Oct. 15, 2020

(65) Prior Publication Data

US 2022/0117323 A1 Apr. 21, 2022

(51) Int. Cl.
*A41C 1/14* (2006.01)
*A41C 1/08* (2006.01)
*A41D 1/22* (2018.01)

(52) U.S. Cl.
CPC ..... *A41C 1/14* (2013.01); *A41C 1/08* (2013.01); *A41D 1/22* (2013.01); *A41D 2400/38* (2013.01)

(58) Field of Classification Search
CPC .... A41C 1/14; A41C 1/08; A41D 1/22; A41D 2400/38
USPC ..... 450/95, 107, 109, 112; 2/255, 256
See application file for complete search history.

(56) References Cited

U.S. PATENT DOCUMENTS 2,301,047 A * 11/1942 Hendley ..... A41D 27/06 160/348
2,501,899 A * 3/1950 Herbener ..... A41C 1/14 D2/702
2,501,900 A * 3/1950 Herbener ..... A41C 1/00 450/146
2,503,357 A * 4/1950 Shelton ..... A41B 9/10 D2/702
2,583,225 A * 1/1952 Murphy ..... A41D 27/06 450/144
2,663,025 A * 12/1953 Siegfried ..... A41D 1/06 2/221
3,185,158 A * 5/1965 Gattuso ..... A41F 9/025 450/95
3,295,531 A * 1/1967 Herbener ..... A41C 1/02 450/109
3,314,432 A * 4/1967 Erteszek ..... A41C 3/08 2/105
3,351,954 A * 11/1967 Chalfin ..... A41C 1/14 450/41
5,157,790 A * 10/1992 Aldridge ..... A41D 13/0531 2/81
6,883,179 B1 * 4/2005 Crum ..... A41D 1/22 2/105
9,648,911 B2 * 5/2017 Welsch ..... A41C 3/06

* cited by examiner

*Primary Examiner* — Gloria M Hale

(57) ABSTRACT

The Perfect Assistant is a garment with shapewear built into the inside. It is manufactured by sewing pieces of fabric together to match a specific waist measurement. Channels that contain strips of boning are inserted along the seams and throughout the width of the sewn pieces of fabric. The completed structure is then sewn to the wrong side of the garment's waist line creating a discrete compression feature that alters the body's measurements.

6 Claims, 3 Drawing Sheets

FASHIONABLE SHAPEWEAR

Figure 1:
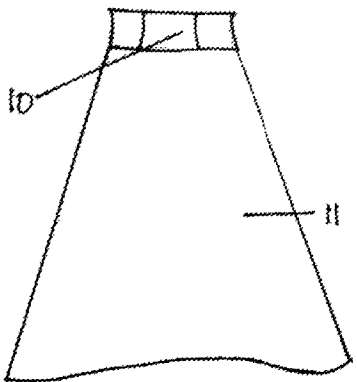

BACKGROUND OF THE INVENTION (1) Field of the Invention: Shapewear (2) Description of the Related Art: The invention combines the fashion and shapewear industry by creating a shapewear garment that gives the appearance of traditional fashion garments while functioning as a waist shaper.

BRIEF SUMMARY OF THE INVENTION

This invention relates to new and useful improvements in shapewear. The invention proposes the construction of an improved waist shaper which will give abdominal support to the wearer and yet enough coverage over the hips and thighs making it appropriate to wear as a garment.

BRIEF DESCRIPTION OF THE SEVERAL VIEWS OF THE DRAWING(S)

FIG. 1—Front view of shapewear garment

Figure 2:
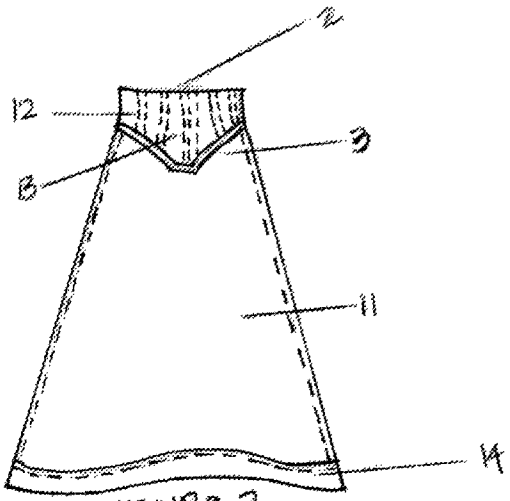

FIG. 2—Inside front of shapewear garment

Figure 3:
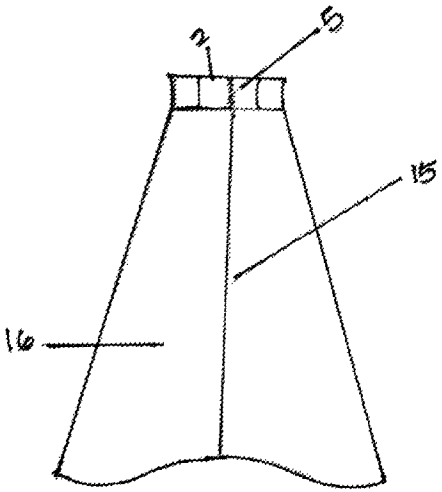

FIG. 3—Back view of shapewear garment

Figure 4:
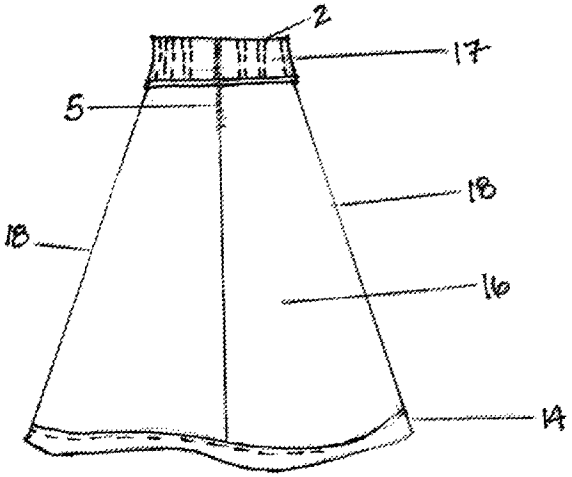

FIG. 4—Inside back view of shapewear garment

Figure 6:
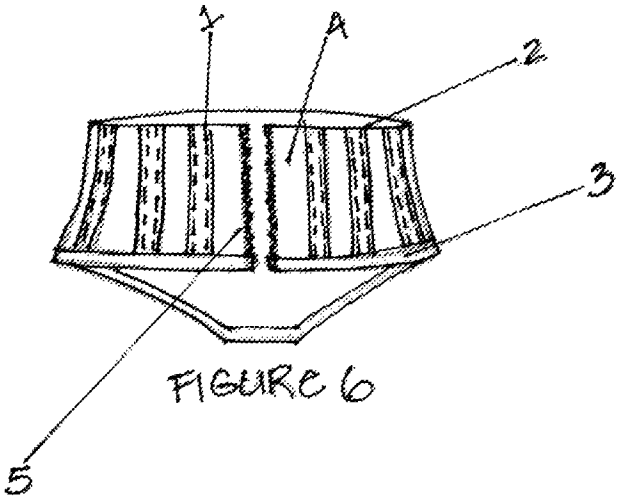
Figure 5:
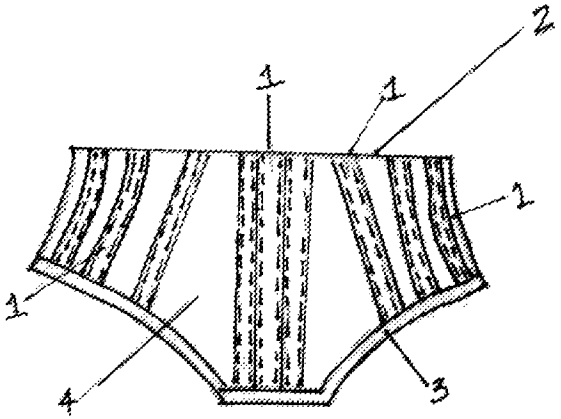
Figure 7:
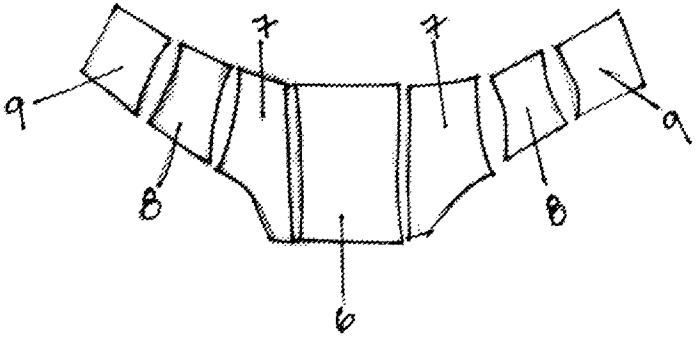
Figures 8, 9:
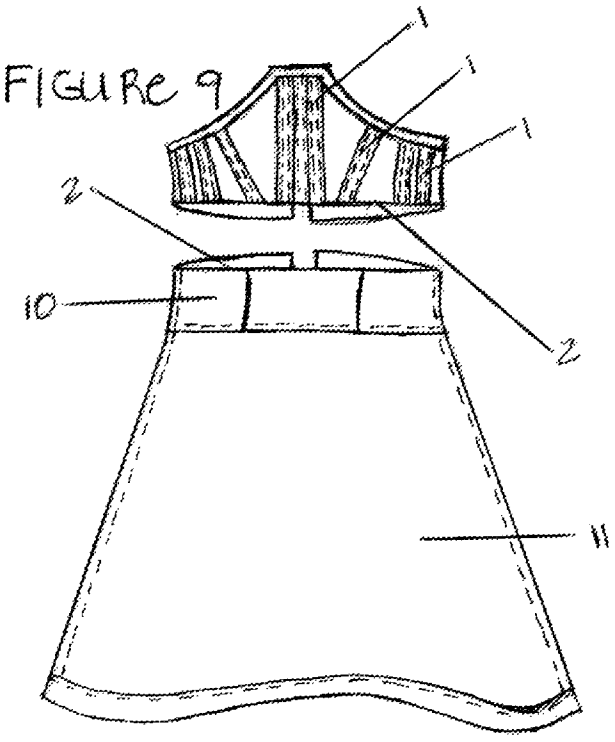

FIG. 5—Inside front view of shapewear garment with strips of steel boning inserted into channels of fabric FIG. 6—Inside back view of shapewear garment with strips of steel boning inserted into channels of fabric FIG. 7—Pieces of fabric sewn together and designed to mimic the woman's torso FIG. 8—Inside view of shapewear garment assembled along the top of the duplicate layer and sewn along the top of shapewear garment and fabric panels extending from mid-circumference FIG. 9—Inside view of shapewear garment with strips of steel boning inserted into channels of fabric aligned to duplicate version of the invention made without boning in preparation for construction

DETAILED DESCRIPTION OF THE INVENTION

The invention consists of 7 pieces of fabric (6, 7, 8, and 9) sewn together and designed to mimic the shape of a torso {FIG. 7}. After this shaper is sewn together (4 and 13), channels (1) made from cotton are sewn along the front, back, and sides {FIGS. 5 & 6}. One-half-inch wide strips of steel boning are inserted into each channel and bound along the bottom (3). A duplicate version of the invention (10) is made without boning. This part is made to create to make the original part unseen. Both parts are sewn along the top edge (2) and the side with the steel boning is pressed towards the inside of the shapewear garment {FIG. 2}. Three panels of fabric (11) and (16) for the front and back cover of the wearer's private area are sewn to the mid-circumference of the shaper and extend past hips {FIG. 1}. The zipper (5) is sewn to the back of the invention and causes compression of the waist and abdominal area when zipped up. A hemline (14) and side seams (18) are created to give a full appearance of a completed garment. A back seam (15) is made to accommodate the zipper.

The invention claimed is:

1. A torso encircling shapewear garment and support corset combination, comprising:

an outer torso encircling garment formed of an outer layer of fabric and an inner mid-torso encircling shapewear corset having an upper edge attached to an upper edge of said outer torso encircling garment; said inner torso encircling shapewear corset comprising a compression fabric layer extending from about a waist, of a wearer and extending downwardly to about a wearer's hips and/or buttocks of said wearer; and wherein said inner torso encircling shapewear corset including fabric channels having boning inserted therein between said outer torso encircling garment fabric and said fabric channel to provide support to said wearer's torso when worn; said outer torso encircling garment and said inner shapewear corset further including a zipper fastener that cinches and compresses said wearer's torso circumference when said zipper is secured and thereby with said inner corset boning provides cinching and compressive support to the wearer's mid torso when said torso encircling shapewear garment and support corset combination is worn.

2. A torso encircling shapewear garment and support corset combination, as claimed in claim 1 and further wherein said compression material comprises woven fabrics including synthetic and natural fabrics.

3. A torso encircling shapewear garment and support corset combination, as claimed in claim 1 and further wherein said fabric channels are formed of at least one of cotton or jacquard material.

4. A torso encircling shapewear garnet and support corset combination, as claimed in claim 1 and further wherein said inner torso encircling corset has a length that extends from the waist of said wearer to the full length of said wearer's torso or said thighs of the wearer.

5. A torso encircling shapewear garment and support corset combination, as claimed in claim 1 and further wherein said inner torso encircling corset is configured and formed of a compression material and said boning inserts to produce a compression force to reduce said wearer's waist measurement up to one inch.

6. A torso encircling shapewear garment and support corset combination, as claimed in claim 1 and further wherein said inner torso encircling corset is configured to be hidden from exterior view of said garment when worn since said inner torso encircling corset waistline upper edge is sewn to and at an upper edge of said outer torso encircling garment.

* * * * *